US006502281B2

(12) United States Patent
Foucault et al.

(10) Patent No.: US 6,502,281 B2
(45) Date of Patent: Jan. 7, 2003

(54) PLUG FOR OPERATIVELY CONNECTING TORSION SPRINGS TO OVERHEAD SHAFTS OF COUNTERBALANCING SYSTEMS USED FOR GARAGE DOORS AND THE LIKE

(75) Inventors: Pierre-Louis Foucault, Saint-Lambert (CA); Normand Savard, Drummondville (CA); Rafael Guay, L'Épiphanie (CA); Samuel Tousignant, St-Léonard d'Aston (CA)

(73) Assignee: Canimex Inc., Drummondville (CA)

( * ) Notice: Subject to any disclaimer, the term of this patent is extended or adjusted under 35 U.S.C. 154(b) by 0 days.

(21) Appl. No.: 09/904,581

(22) Filed: Jul. 13, 2001

(65) Prior Publication Data

US 2002/0043351 A1 Apr. 18, 2002

(30) Foreign Application Priority Data

Jul. 14, 2000 (CA) ..... 2313946

(51) Int. Cl.[7] ..... E05F 1/08

(52) U.S. Cl. ..... 16/197; 16/401; 160/191; 160/201; 160/318; 49/200

(58) Field of Search ..... 160/191, 192, 160/318, 201, 193; 267/173, 177, 179, 154, 155; 16/198, 401, 197; 242/375; 49/199, 200

(56) References Cited

U.S. PATENT DOCUMENTS 1,835,258 A * 12/1931 Axe
2,066,558 A * 1/1937 Dautrick
2,528,869 A * 11/1950 De Laney
2,932,057 A * 4/1960 Pemberton
3,685,567 A * 8/1972 Pemberton et al.
3,763,916 A * 10/1973 Gossling
3,779,537 A * 12/1973 Kalister
4,504,252 A * 3/1985 Honma
4,817,927 A * 4/1989 Martin
4,852,378 A * 8/1989 Greco
6,134,835 A * 10/2000 Krupke et al.
6,174,575 B1 * 1/2001 Foucault et al.
6,263,541 B1 * 7/2001 Scates

* cited by examiner

*Primary Examiner*—Blair M. Johnson
(74) *Attorney, Agent, or Firm*—Merchant & Gould P.C.

(57) ABSTRACT

A plug for use in a counterbalancing mechanism of a cable-operated door. The plug is mounted about an overhead shaft and used for operatively connecting the overhead shaft to a torsion spring coaxially mounted thereon. The plug includes a cylindrical collar and a cylindrical flange. The cylindrical collar has opposite first and second portions. The collar is provided with a hooking slot for hooking a free end of the torsion spring therein and the torsion spring has a segment coaxially mounted about the first portion of the collar. The cylindrical flange is rigidly affixed to the second portion of the collar. The flange is used for transferring a torque between the torsion spring and the overhead shaft when the flange is securely fixed about the overhead shaft. The plug further includes a shouldering floor of a given length faced against the hooking slot and extending inside the collar, from the second portion towards the first portion thereof, between the collar and the overhead shaft.

19 Claims, 12 Drawing Sheets

SECTION F-F

PLUG FOR OPERATIVELY CONNECTING TORSION SPRINGS TO OVERHEAD SHAFTS OF COUNTERBALANCING SYSTEMS USED FOR GARAGE DOORS AND THE LIKE

FIELD OF THE INVENTION

The present invention relates to a plug, also known as a "collar" or an "anchor", such as the ones used for operatively connecting torsion springs to overhead shafts of counterbalancing mechanisms used for garage doors and the like, in order to allow a torque transfer between the torsion spring and the overhead shaft so as to counterbalance such cable-operated doors.

BACKGROUND OF THE INVENTION

It is known in the art that large, vertical, cableoperated doors, such as commercial and residential sectional garage doors, usually require counterbalancing mechanisms to counterbalance the weight of the door in order to decrease the force required to open the door and also facilitate its closing from a raised to a lowered position. Large sectional garage doors used in commercial and residential applications may be manually or power operated. In either case, but particularly for manually operated doors, counterbalancing mechanisms have been used for many years to counterbalance the weight of the door and control its opening and closing movements so that one person can easily control the operation of the door. Counterbalancing mechanisms are also advantageous for power operated overhead doors since they reduce the power requirements needed for the motor and they lower the structural strength required for the door opening and closing mechanism. In other words, lighter weight, lower cost. door controlling mechanisms may be used if a counterbalancing mechanism is connected to the door to assist it in its opening and closing movements. Furthermore, the provision of a counterbalancing mechanism minimizes the chance of a rapid and uncontrolled closing of the door in the event of a failure of the door opening and closing mechanism, which can result in serious injury or damage.

It is also known in the art that a widely used type of counterbalancing mechanism generally comprises a pair of spaced apart cable drums connected to flexible cables. each cable being in turn connected to a lower opposite side edge of the garage door. The cable drums are usually mounted on a overhead shaft which is supported above the door opening and is connected to one or more torsion springs which are each fixed to the shaft at one end, and secured to a fixed structure such as the wall for example at the other end, so that the cable drums are biased to rotate in a direction which winds the cables onto the drums and counteracts the weight of the door connected to the cables. The torsion springs are adjusted to properly balance the weight of the door so that minimal opening and closing efforts are required, either manually or when motor controlled. An example of a conventional cable-operated door and its corresponding counterbalancing mechanism is shown in FIG. 1.

It is also known in the art that conventional, low cost adjustment devices used for the abovementioned type of counterbalance mechanism, and widely utilized in the garage door industry, are generally cylindrical "collars" commonly referred to also as "plugs" (or "cones") which are connected to the so-called fixed ends of the torsion springs and are thus mounted on the aforementioned shaft for adjusting the deflection of the springs to preset the counterbalance force. The aforementioned collars usually include one or more setscrews which lock the collars to the shaft to prevent rotation thereabout except during normal adjustment of the spring deflection. The collars also usually include sockets for receiving winding bars whereby the springs are manually preset, or "preloaded", by rotating the collars with respect to the shaft using the winding bars and then locking the collars to the shaft with the setscrews. Each collar also may include a slot onto which a corresponding free end of the torsion spring is hrooked on. These slots are usually T-shaped,, and are thus commonly known as "T-slots". An example of a prior art T-slot collar is shown in FIGS. 2 and 3.

Presently, the T-shape of the slots of the plugs known in the art allows the introduction of the spring's tail without the use of any tool. Once the spring tail is introduced into the T-slot of the collar, both the collar and the spring are then introduced onto a shaft and installed on site, after which the collar is pushed towards the spring and then rotated around the spring axis in order to have the spring tail blocked there by the T-slot collar. The combined slot and shaft hold the assembly together without any other accessories.

An important problem associated with the aforementioned type of counterbalancing mechanism, or with any other type of counterbalancing mechanism which uses collars (also known as "anchors") having T-slots and tensioning springs, is that if the tail of the spring is too long, it will contact the shaft, and may eventually groove it to the point where the shaft may fail and cause personal injuries or render the counterbalancing mechanism Inefficient or inoperable.

Another important problem associated with the aforementioned type of counterbalancing mechanism, or with any other type of counterbalancing mechanism which uses conventional collars and tensioning springs, is that several of the plugs used in the industry do not allow a great number of total active spring coils to be used, since the first three to rive coils are generally used to maintain the spring onto the plug. An example of such plugs is shown in FIGS. 4 and 5.

Yet another important problem associated with the aforementioned type of counterbalancing mechanism, or with any other type of counterbalancing mechanism which uses collars having T-slots and tensioning springs, is the phenomenon known as "clamping", an example of which is shown in FIGS. 6 to 9.

Yet another problem associated with the aforementioned type of counterbalancing mechanism, or with any other type of counterbalancing mechanism which uses collars having T-slots and tensioning springs, is that they are not devised to gauge the adequateness of the dimensions of the torsional springs mounted thereon.

Yet another important problem associated with the aforementioned type of counterbalancing mechanism, or with any other type of counterbalancing mechanism which uses winding collars having T-slots and tensioning springs, arises from the fact that the springs mounted thereon tend to "wave" due to extension and contraction.

Hence, in light of the aforementioned, there is a need for an improved device for operatively connecting torsion springs to overhead shafts of counterbalancing systems used for cableoperated doors, such as garage doors and the like.

SUMMARY OF THE INVENTION

The object of the present invention is to provide a "plug", also known as a "collar", an "anchore", or a "cone", which satisfies some of the above-mentioned needs and is thus an improvement over the devices known in the prior art.

More particularly, the object of the present invention is to provide a new approach for operatively connecting torsion springs to overhead shafts of counterbalancing systems used for garage doors and the like.

In accordance with the present invention, the above object is achieved with a plug for use in a counterbalancing mechanism of a cable-operated door, said plug being mounted about an overhead shaft and used for operatively connecting said overhead shaft to a torsion spring coaxially mounted thereon, said plug comprising:

a cylindrical collar having opposite first and second portions, said collar being provided with a hooking slot for hooking a free end of the torsion spring therein and said torsion spring having a segment coaxially mounted about the first portion of the collar; and a cylindrical flange rigidly affixed to the second portion of the collar, said flange being used for transferring a torque between the torsion spring and the overhead shaft when the flange is securely fixed about the overhead shaft;

wherein the plug further comprises a shouldering floor of a given length faced against the hooking slot and extending inside the collar, from the second portion towards the first portion thereof, between said collar and the overhead shaft.

Preferably, the collar is eccentrically mounted about the overhead shaft.

The objects, advantages and other features of the present invention will become more apparent upon reading of the following non-restrictive description of a preferred embodiment thereof, given for the purpose of exemplification only with reference to the accompanying drawings.

DETAILED DESCRIPTION OF A PREFERRED EMBODIMENT OF THE INVENTION

Figure 1:
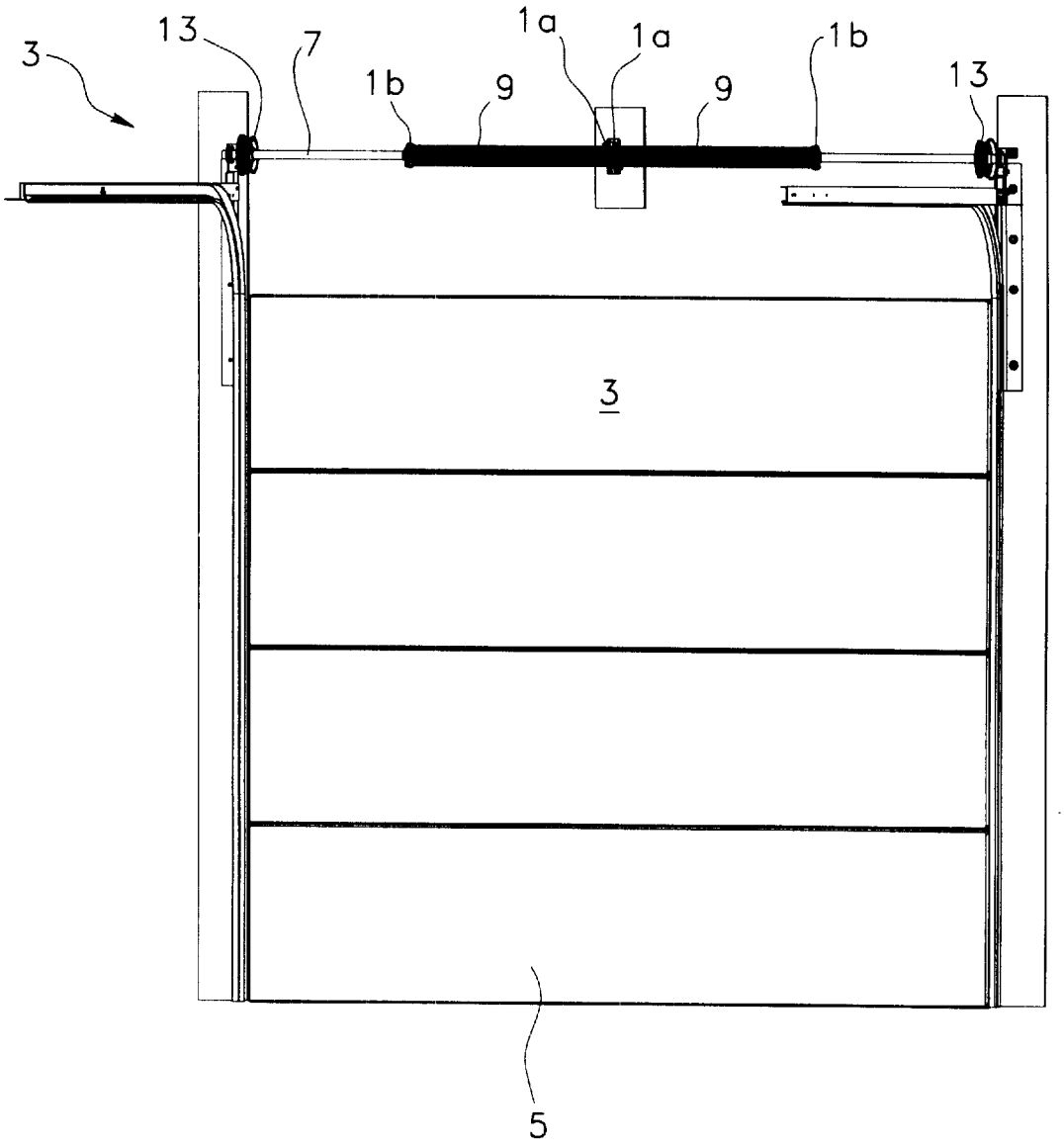
FIG. 1 PRIOR ART
FIG. 1 is a perspective view of a sectional garage door connected to a counterbalancing mechanism provided with stationary and winding plugs according to the prior art.

In the following description, the same numerical references refer to similar elements. The embodiments shown in FIGS. 10–27 are preferred.

Moreover, although the present invention was primarily designed for use with a counterbalancing mechanism of a garage door, i may be used for counterbalancing mechanisms of other kinds of doors, such as slidable truck doors, or with any other items suspended by a cable, as apparent to a person skilled in the art. For this reason, the expression "garage door" should not be taken as to limit the scope of the present invention and includes all other kinds of doors or items with which the present invention may be useful.

Moreover, in the context of the present invention, the expressions "plug", "collar", "anchor", and any other equivalent expression known in the art (such as "cone" for example) used to designate those structures employed to operatively connect torsion springs onto overhead shafts of counterbalancing mechanisms used for garage doors and the like will be used interchangeably. Furthermore, expressions such as "spring tail" and "free end", as well as any other equivalent expressions and/or compound words thereof, may also be used interchangeably in the context of the present description. The same applies for any other mutually equivalent expressions, as also apparent to a person skilled in the art.

In addition, although the preferred embodiment of the present invention as illustrated in the accompanying drawings comprises components such as flat outer surfaces, setscrews, sockets, etc., and although the preferred embodiment of the present invention as shown consists of certain geometrical configurations such as being "eccentrically" mounted about the overhead shaft, having a substantially "triangular-shaped" slot, comprising a "cylindrical" collar and flange, etc., not all of these components and geometries are essential to the invention and thus should not be taken in their restrictive sense, i.e. should not be taken as to limit the scope a of the present invention. It is to be understood, as also apparent to a person skilled in the art, that other suitable components and cooperations thereinbetween, as well as other suitable geometrical configurations may be used for the plug according to the present invention, as will be explained hereinafter, without departing from the scope of the invention.

The plug 1 according to the preferred embodiment of the invention as it is illustrated with accompanying drawings is a plug 1 for use in counterbalancing mechanisms 3 of garage doors 5 and the like. The plug 1, also known as a "collar", an "anchor", and/or a "cone", as aforementioned, is used to operatively connect an overhead shaft 7 to a torsion spring 9 coaxially/concentrically mounted onto the overhead shaft 7.

Referring to FIG. 1, most cable-operated doors 5, whether manually or power-operated, are connected to an overhead counterbalancing mechanism 3 that provides a counterbalancing force in order to decrease the force required to open the door 5 and also facilitate its closing. The garage door 5 is usually connected to the counterbalancing mechanism 3 by means of two cables, one at the right and one at the left. The cables are usually made of steel and the lower free end of each cable is usually attached at the bottom of the door 5. As illustrated in FIG. 1, each cable cooperates with a corresponding cable drum 13 which is mounted to the overhead shaft 7 in order to facilitate raising and lowering of the cable-operated door 5. Torque is transferred between the torsion spring 9 and the overhead shaft 7 by means of plugs which operatively connect the shaft 7 to the spring 9 in order to counterbalance the weight of the garage door 5. Usually, each torsion spring 9 is fixed to the overhead shaft 7 at one end, by means of a plug known as a "winding plug", and operatively secured to the wall at the other end, by means of another plug known as a "stationary plug". The above-mentioned types of counterbalancing mechanisms can be found in other types of cable-operated doors 5, such as slidable truck doors for example.

Figure 2:
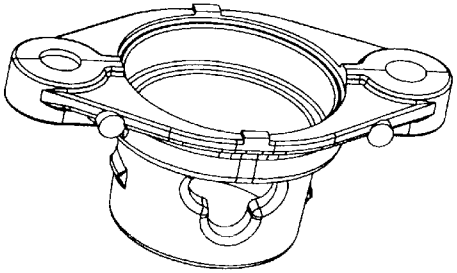
FIG. 2 PRIOR ART
FIG. 2 is a perspective view of one of the stationary plugs shown in FIG. 1.
Figure 3:
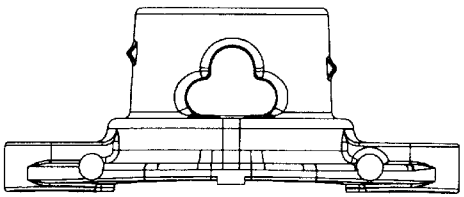
FIG. 3 PRIOR ART
FIG. 3 is a side elevational view of the stationary plug shown in FIG. 2.

Referring now to FIGS. 2 and 3, an example of a typical T-slot anchor plug, also known as a "cone", as already known in the prior art, is shown. The form of the slot allows the introduction of the free end of the spring 9, also known as a "spring tail", without the use of any tool. Once the spring tail is introduced into the T-slot of the collar, both the collar and the spring 9 are then introduced onto the i shaft 7 and installed on site, after which the collar is pushed towards the spring 9 and then rotated around the spring axis in order to have the spring tail blocked there by the T-slot collar. This type of plug is suitable for most torsion springs but causes several problems, in that, among other things, if the spring tail is too long, it will contact the overhead shaft 7, and may eventually groove it to the point where the shaft 7 may break and cause injury or render the counterbalancing mechanism 3 inefficient or inoperable.

Figure 4:
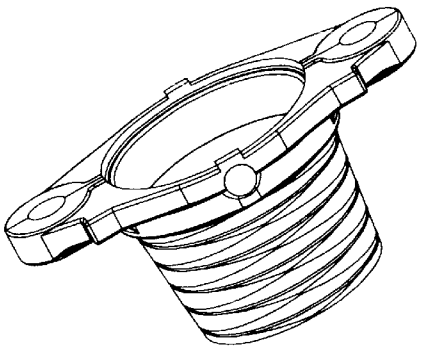
FIG. 4 PRIOR ART
FIG. 4 is a perspective view of another stationary plug according to the prior art.
Figure 5:
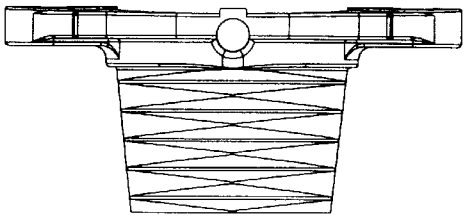
FIG. 5 PRIOR ART
FIG. 5 is a side elevational view of the stationary plug shown in FIG. 4.

Referring now to FIGS. 4 and 5, another example of a typical anchor plug, as already known in the prior art, is shown. An important problem associated with this type of plug is that the mounting of a spring 9 thereon becomes very difficult since special tooling is required for the introduction of the spring 9 onto the plug. Furthermore, because of its design, this type of plug introduces "dead" coils into a spring mounted thereon. These dead coils cannot be used for counterbalancing purposes and thus translate into useless weight added, which is disadvantageous structurally and economically.

Figure 6:
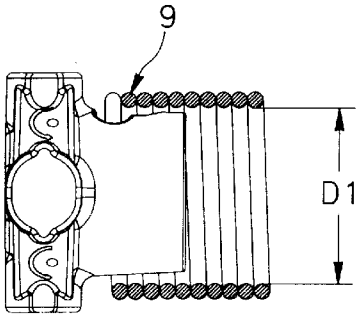
FIG. 6 PRIOR ART
FIGS. 6 to 9 are schematic representations of the phenomenon known as "clamping" manifested on one of the winding plugs shown in FIG. 1.
Figure 7:
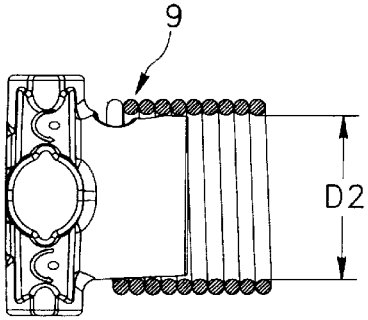
FIG. 7 PRIOR ART
Figure 8:
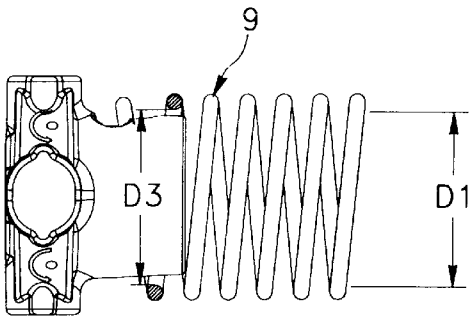
FIG. 8 PRIOR ART
Figure 9:
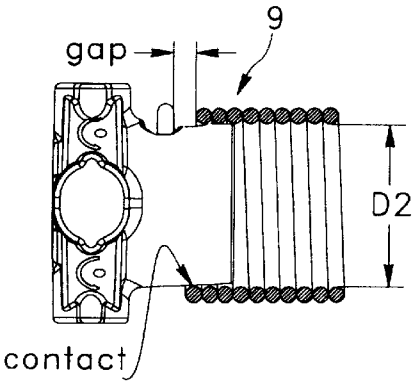
FIG. 9 PRIOR ART

Referring now to FIGS. 6 to 9, there are shown schematic representations of the phenomenon known in the prior art as "clamping", as manifested on a typical plug. Indeed, FIG. 6 shows the spring 9 and plug assembly before the spring 9 is put under tension. As can be seen, the spring 9 has inside diameter D1 which is greater than the outside diameter of the plug itself. FIG. 7 shows the plug and spring 9 assembly when the spring 9 is put under tension, that is, after the plug has been wound around the shaft 7 and securely affixed thereon by means of fasteners, such as setscrews for example. Consequently, the spring 9 now has an internal diameter D2 which is smaller than D1, which leads to the "damping" of the collar by the first few coils of the spring 9 which are positioned thereabout, as better shown in FIG. 7. FIG. 8 now shows the assembly when the garage door 5 is completely raised. Since tension on the spring 9 is released due to the raising of the door 5, the spring 9 returns to its original diameter D1, and the coils of the spring 9 become spaced apart. When the door 5 is lowered again, as better shown in FIG. 9, i.e. when the garage door 5 is being closed, the coils of the spring 9 want to return to their previous configuration as shown in FIG. 7, i.e. back to internal diameter D2; however, some of the abovementioned first few coils are prevented from getting back onto the collar. Consequently, the remaining first few coils which are left about the collar have a tendency to tighten about the plug leaving a gap between them and the spring tail, as clearly illustrated in FIG. 9. This poses a problem since this may block the counterbalancing mechanism 3 and prevent the door 5 from closing completely or properly. Very often, this results into a clearance left between the bottom of the garage door 5 and the floor of the garage.

According to the present invention and as better shown in FIGS. 10–20, the plug 1, whether it is a stationary plug la or a winding plug 1, comprises a cylindrical collar 15 and a cylindrical flange 17. The cylindrical collar 15 has opposite first and second portions 19, 21. The collar 15 is provided with a hooking slot 23 for hooking a free end 25 of the torsion spring 9 therein and the torsion spring 9 has a segment coaxially mounted about the first portion 19 of the collar 15. The cylindrical flange 17 is rigidly affixed to the second portion 21 of the collar 15. The flange 17 is used for transferring a torque between the torsion spring 9 and the overhead shaft 7 when the flange 17 is securely fixed about the overhead shaft 7. The plug 1 according to the present invention is characterized in that it further comprises a shouldering floor 27 of a given length faced against the hooking slot 23 and extending inside the collar 15, from the second portion 21 towards the first portion 19 thereof, between the collar 15 and the overhead shaft 7.

Figure 10:
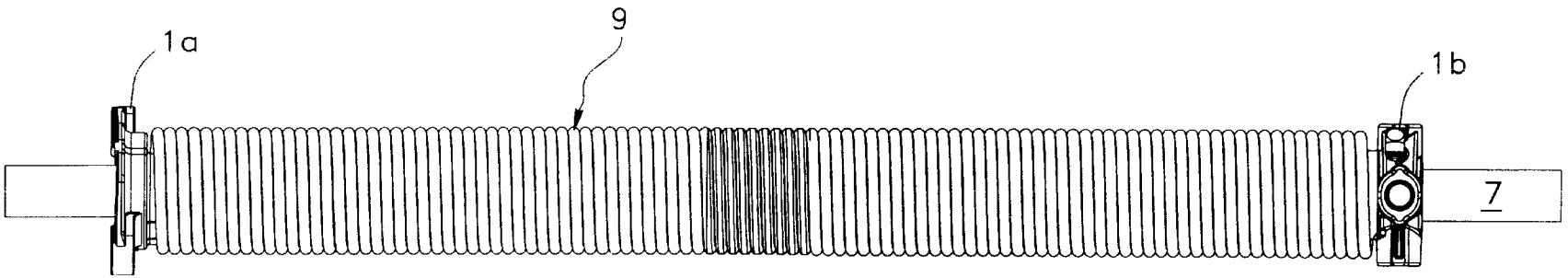
FIG. 10 is a side view of a stationary plug and a winding plug according to preferred embodiments of the invention, said stationary and winding plugs being shown cooperating respectively with a free end of the torsion spring.
Figure 11:
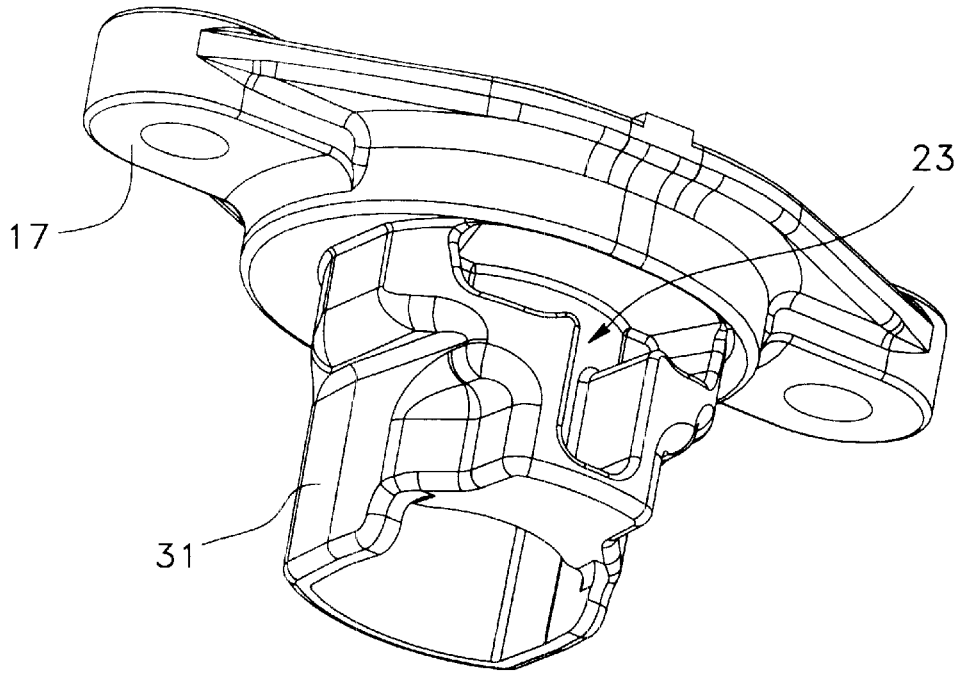
FIG. 11 is a perspective view of the stationary plug shown in FIG. 10.
Figure 12:
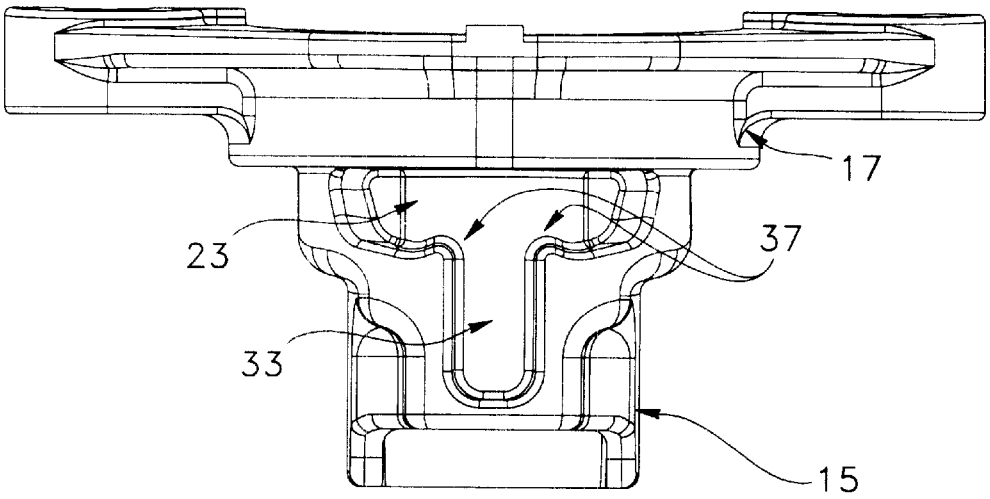
FIG. 12 is a side elevational view of the stationary plug shown in FIG. 11.
Figure 13:
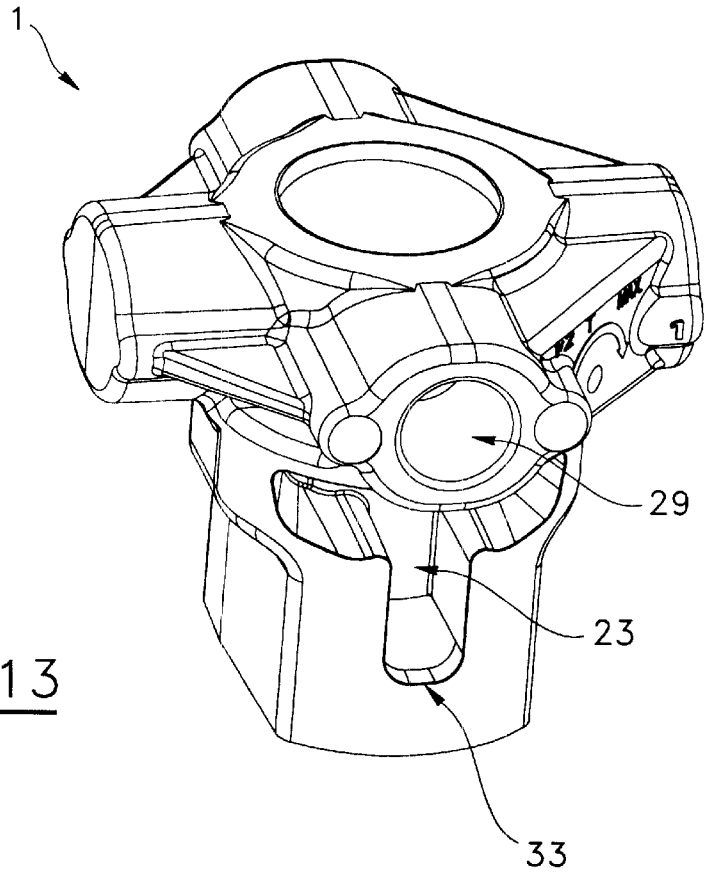
FIG. 13 is a perspective view of the winding plug shown in FIG. 10.
Figure 14:
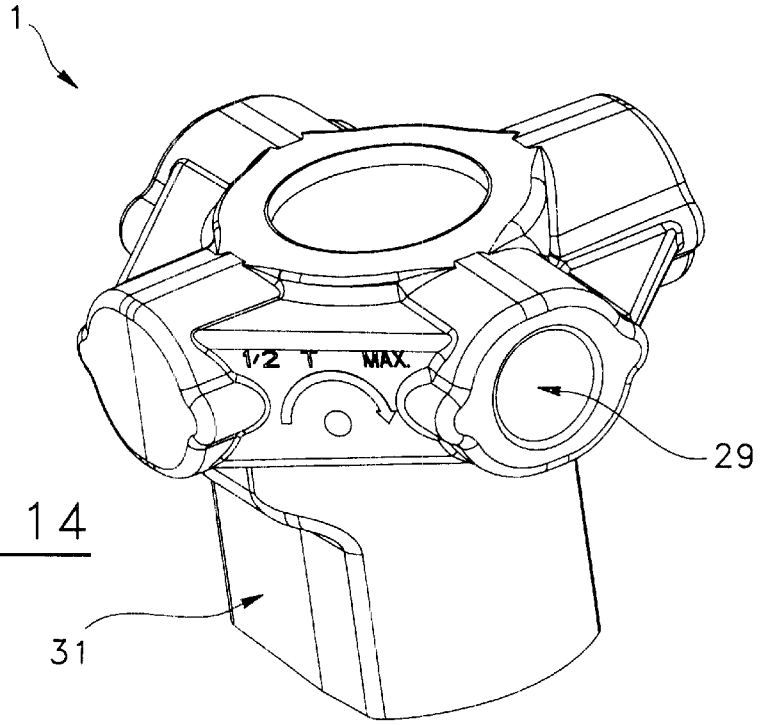
FIG. 14 is another perspective view of the winding plug shown in FIG. 13.
Figure 17:
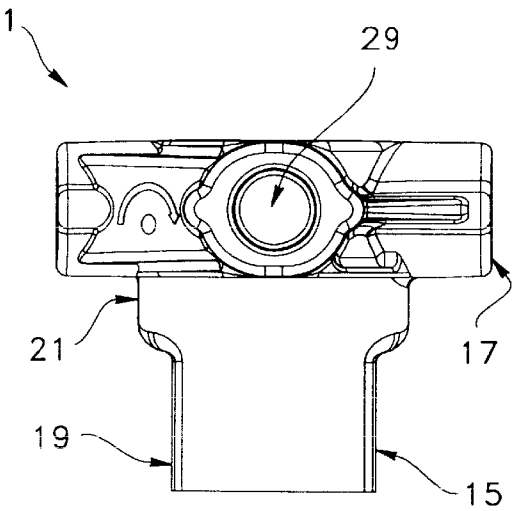
FIG. 17 is another side elevational view of the winding plug shown in FIG. 13 .
Figure 16:
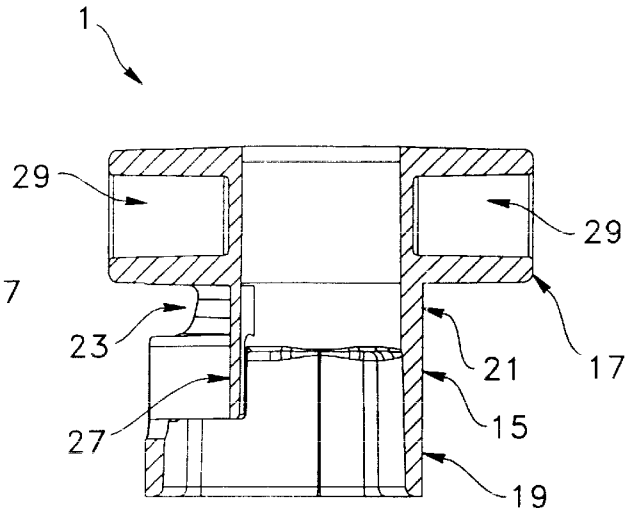
FIG. 16 is a cross-sectional view taken along line B—B of the plug shown in FIG. 15.
Figure 15:
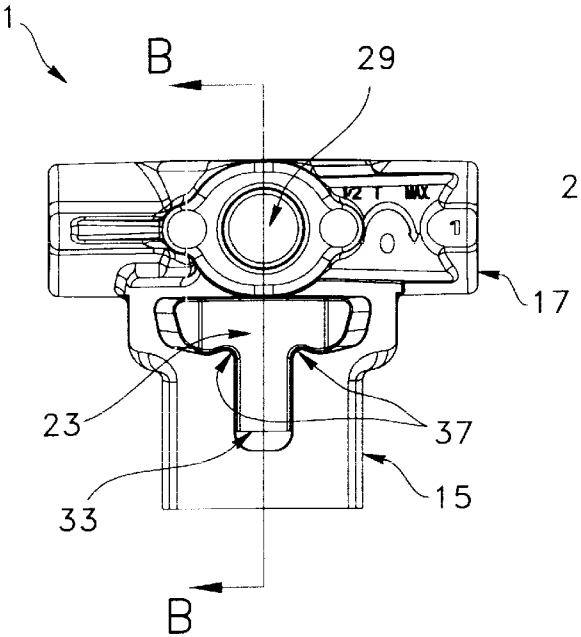
FIG. 15 is a side elevational view of the winding plug shown in in FIG. 13.
Figure 20:
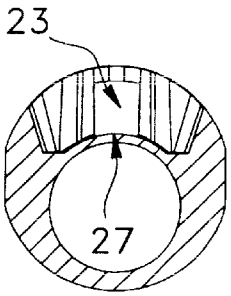
FIG. 20 is a cross-sectional view taken along line F—F of the winding plug shown in FIG. 19.
Figure 19:
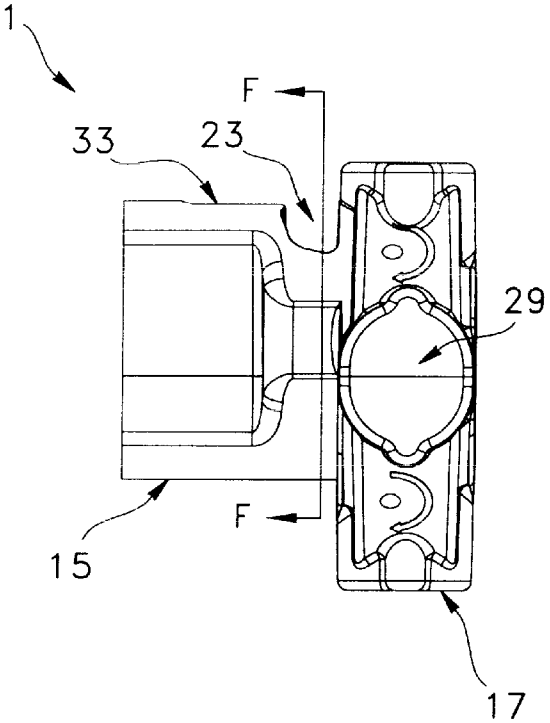
FIG. 19 is a side plan view of the winding plug shown in FIG. 13.
Figure 18:
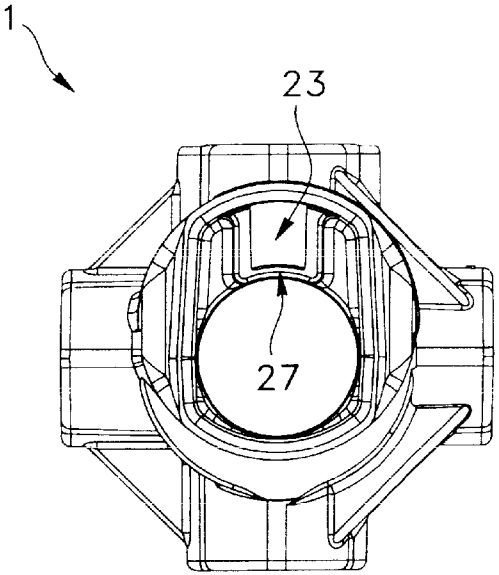
FIG. 18 is a bottom plan view of the winding plug shown in FIG. 13.
Figure 22:
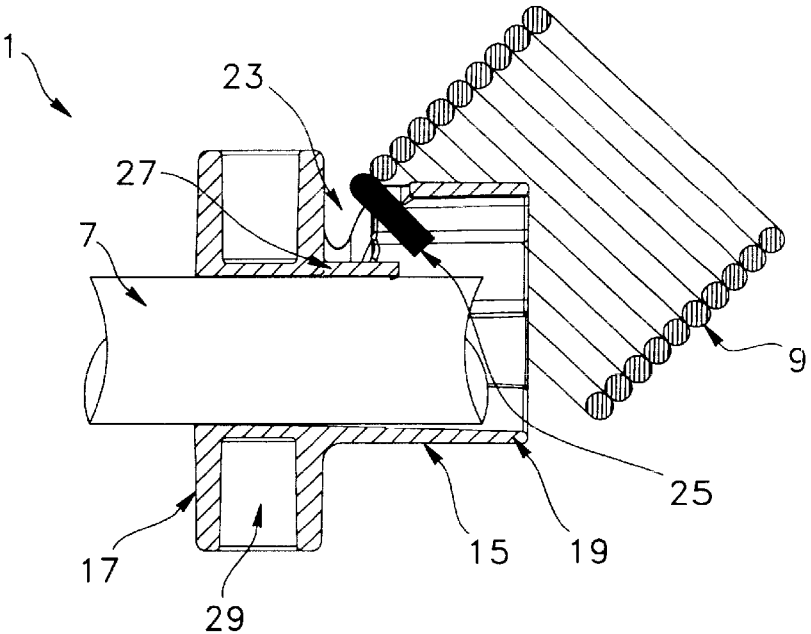
FIGS. 21 to 24 are schematic representations of the way to insert a torsion spring onto the winding plug shown in FIG. 13.
Figure 21:
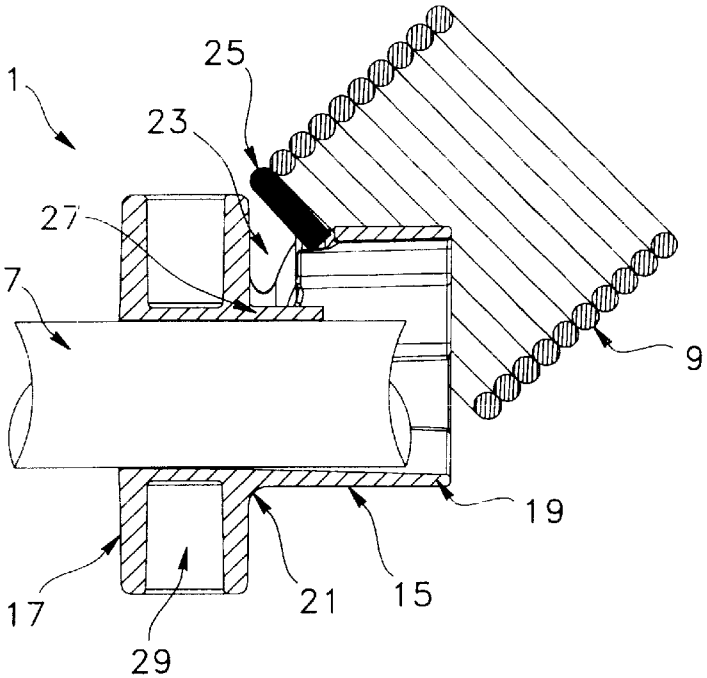
Figure 24:
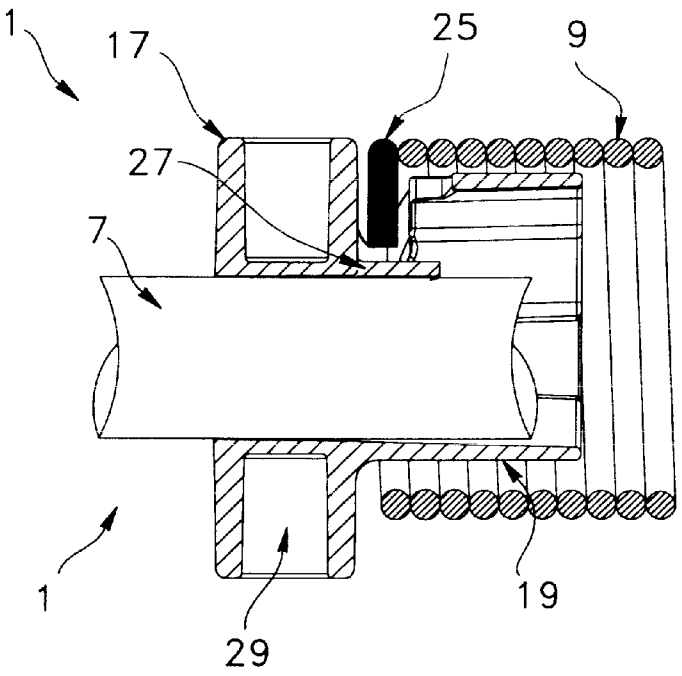
Figure 23:
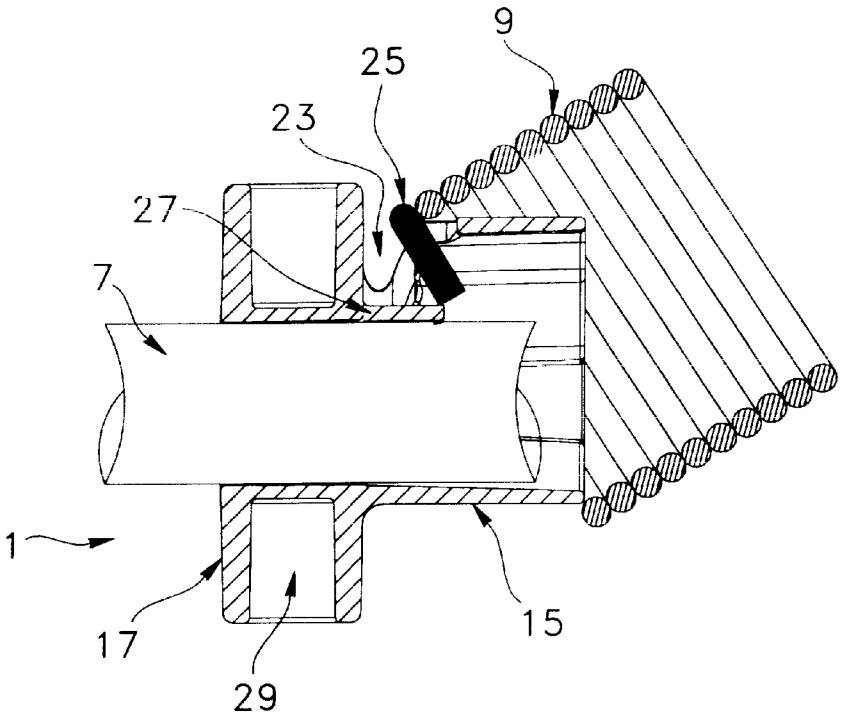

According to a preferred embodiment of the invention and as better shown in FIG. 10, each torsion spring 9 is preferably coaxially mounted onto the overhead shaft 7 and is preferably connected with a stationary plug 1*a* at one end, and a winding plug 1*b* at the other end. The stationary plug 1*a* is preferably connected to a fixed structure (not shown), such as for example, a bracket rigidly mounted to a wall. The winding plug 1*b* is removably fixed to the overhead shaft 7 and is used to operatively connect the torsion spring 9 to the overhead shaft 7 so as to allow a torque transfer between the latter two. Preferably, the flange 17 of the winding plug 1*b* is provided with winding means for presetting a given torque onto the torsion spring 9 prior to securing the plug 1 onto the overhead shaft 7. Although the winding means may consist of any appropriate device known and used in the art, they preferably consist of sockets 29 for receiving winding bars in order to manually preset a given torque onto the torsion spring 9, prior to securing the winding plug 1*b* onto the overhead shaft 7, by rotating the winding plug 1*b* with respect to the overhead shaft 7. Once an appropriate amount of torque ("preload") has been applied to the torsion spring 9 in order to allow an appropriate counterbalancing force as apparent to a person skilled in the art, the winding plug 1*b* is secured to the shaft 7 by means of setscrews provided for that purpose in order to prevent any substantial rotational relative movement between the winding plug 1*b* and the shaft 7, in order to assure a good torque transfer between the torsion spring 9 and the overhead shaft 7. Preferably, the winding plug 1*b* may allow an appropriate relative sliding of the corresponding spring end 25 attached thereon so as to compensate for the contraction or extension of the spring in function of the compression torque. The plugs 1, whether stationary or winding, can be easily removed from the overhead shaft 7, for easier maintenance and/or repair of the counterbalancing mechanism 3, and more specifically for spring replacement, by unfastening the setscrews and/or unhooking the free ends 25 of the torsion springs 9, or by any other appropriately safe manner, as apparent to a person skilled in the art.

As better shown in FIGS. 11–27, the present invention is characterized in that the plug 1 further comprises a shouldering floor 27 of a given length faced against the hooking slot 23 and extending inside the collar 15, from the second portion 21 towards the first portion 19 thereof, between the collar 15 and the overhead shaft 7. As shown and as can be easily understood, this feature enables to block the free end 25 of the torsion spring 9 from accessing the shaft 7, i.e. from rubbing against the shaft 7. Indeed, this floor 27 blocks access of the spring tail to the shaft 7 and virtually eliminates the risk of shaft failure. Preferably, the length of the shouldering floor 27 and the distance thereof from the hooking slot 23 are selected for impeding a torsion spring 9 having a free end 25 of a given maximal length from being hooked onto the plug 1. Thus, the floor 27 in combination with the above-mentioned additional feature, also enables to prevent the insertion of springs 9 that have tails which are too long. Indeed, as better shown in FIG. 22, there is an opening at the end of the shouldering floor 27 for insertion of the tail. If the tail is too long, the operations of FIGS. 23 and 24 will not be possible. Furthermore, the collar 15 preferably comprises two flat outer surfaces 31 extending longitudinally and in parallel along the collar 15, as better shown in FIGS. 11, 14 and 17. The outer surfaces 31 are devised, among other things, to facilitate the insertion of the spring 9 onto the plug 1. Preferably also, the outer diameter of the collar 15, the distance between the hooking slot 23 and an extremity of the collar 15 at the first portion thereof, and the distance between the two flat outer surfaces 31 are selected for impeding a torsion spring 9 having a given minimal inside diameter from being hooked onto the plug 1. Indeed, if the inside diameter of the spring 9 is too small. going from FIG. 22 to FIG. 23 will not be possible. Thus, as a result of the aforementioned it can be easily understood that the plug 1 according to the present invention can also be used as a "calibrating" tool to ensure that a torsion spring 9 mounted thereon has appropriate dimensions, otherwise the spring 9 may not be allowed to be properly mounted thereon due to the above-mentioned features of the plug 1.

Figure 27:
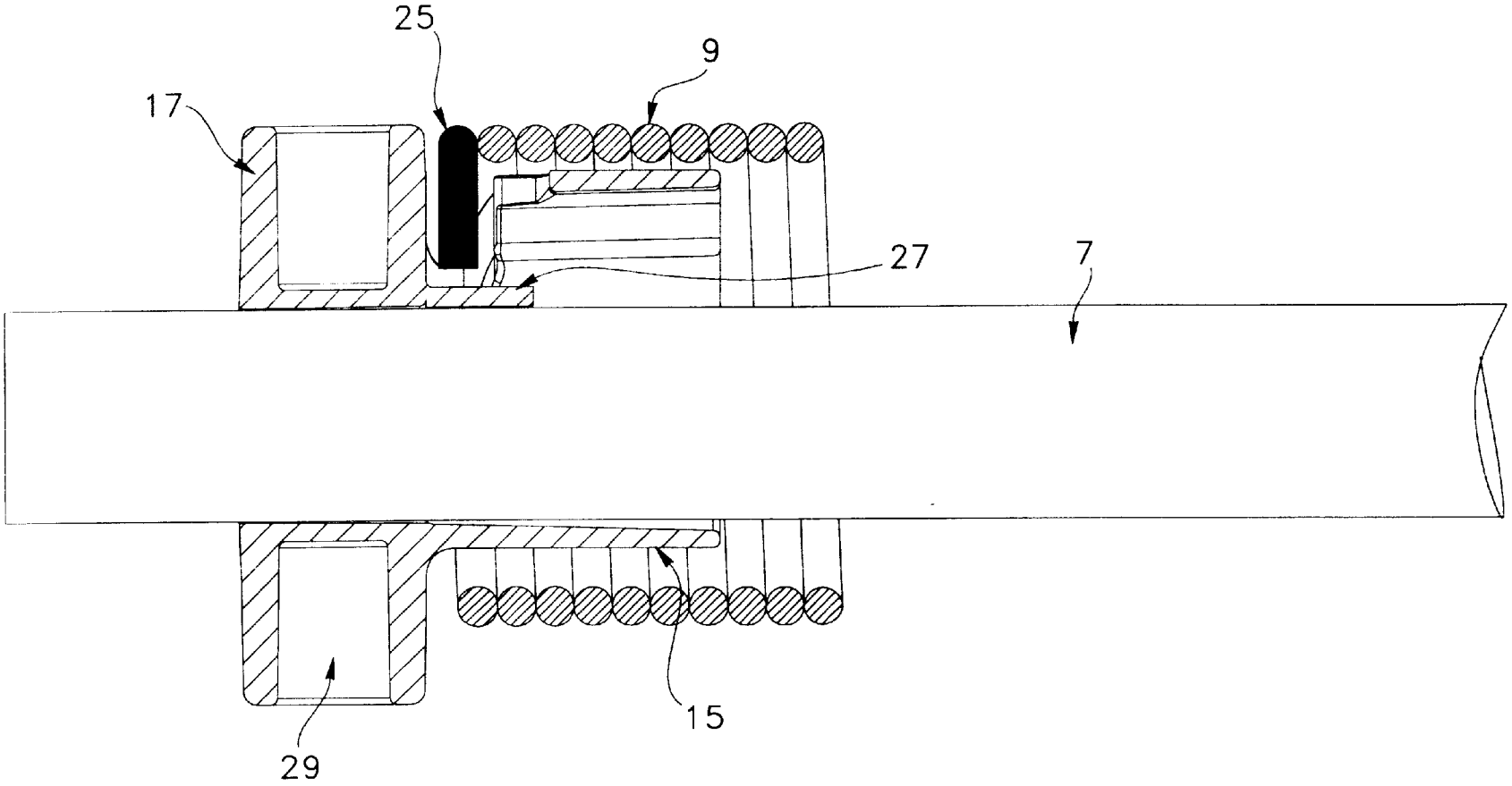
FIG. 27 is a cross-sectional view of the winding plug shown in FIG. 13 mounted about an overhead shaft, said plug being shown with a torsion spring hooked thereon.

Preferably also, in order to be able to have enough space for the spring tail and the shouldering floor 27, the plug 1 is preferably mounted eccentrically from the head, as better shown in FIG. 27. Tests have shown that this eccentricity does not impair the functioning of the counterbalancing mechanism 3, nor does it introduce any imbalances. Therefore, although it is not essential, the collar 15 is preferably eccentrically mounted about the overhead shaft 7. An. advantage of this is that it allows for a more compact plug 1 than one which would be concentrically mounted on the overhead shaft 7, as apparent to a person skilled in the art. Another advantage of this is that it also allows to increase the tolerances on the tail of the spring 9, as also apparent to a person skilled in the art.

Figure 25:
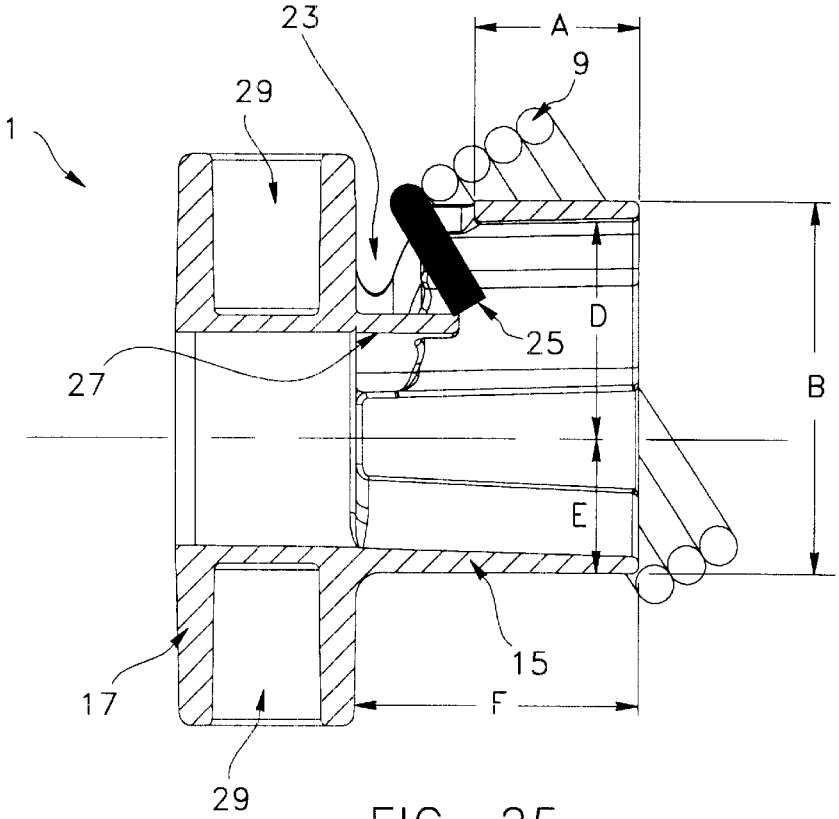
FIG. 25 is a partial enlarged view of what is shown in FIG. 23.

As it is known in the art, good functionality of a counterbalancing mechanism 3 requires adequate spring tolerances. In order to control these spring tolerances, the plug 1 according to the present invention is provided with appropriate dimensions A to F. as known and selected by a person skilled in the art and as better shown in FIGS. 25 and 26. Indeed, dimensions A, B and C are preferably designed to ensure that springs 9 having a given minimal inside diameter can only be inserted about the plug 1. Furthermore, dimension 8 of the plug 1 is preferably selected to substantially decrease "clamping" effects. The location of the hooking slot 23 from the first portion 19 of the collar 15 is also preferably selected so as to increase the maximal amount of active coils possible for a given torsional spring 9. Dimensions A. B and C are preferably selected also for facilitating the insertion of a torsional spring 9 and for controlling the dimensions thereof, as explained hereinabove. The shape and sire of the hooking slot 23 are preferably selected for facilitating the forming, i.e. folding, of the spring tail as well as for insuring proper hooking thereon. The length of the shouldering floor 27 is preferably selected to ensure an adequate protection of the overhead shaft 7 from the spring tail. The eccentricity of the plug 1 mounted about the overhead shaft 7, as selected by varying dimensions D and E of the plug 1, are preferably selected for increasing the tolerances on the spring tail. Furthermore, dimension F of the plug 1 is preferably selected for reducing the waving effect due to spring extension and contraction, a phenomenon also known as "cocking" in the American industry. Moreover, in order to ensure easy spring insertion, two flat outer surfaces 31 are preferably provided longitudinally and in parallel along the collar 15 of the plug 1, as aforementioned and as better shown in FIG. 26. Consequently, as shown in FIG. 25, if the spring's inside diameter is too small, it will be impossible to insert it about the plug 1. The combination of all of the above-mentioned controlling features allows for an on-site verification of the spring's dimensions. Preferably also, as better shown in FIGS. 12, 13, 15, and 26, the hooking slot 23 comprises a longitudinal groove 33. As better shown in FIG. 26, the hooking slot 23 preferably further comprises two notches 35, these notches 35 being substantially V-shaped and having an appropriate angle for ensuring a suitable forcing and locking of the spring tail into the hooking slot 23 of the plug 1. Preferably also, the width of the longitudinal groove 33 is selected so that, if the size of the spring 9 (i.e. the diameter of the coils) is too large, it will not fit inside the longitudinal portion of the groove 33. As better shown in FIGS. 12 and 15, the hooking slot 23 is preferably also provided with bulges 37 at the intersection of its groove 33 and notches 35 for blocking the spring 9 during the operation thereof. Hence, as can be easily understood from the above-discussed, the plug 1 according to the present invention is not only used for operatively connecting torsion springs 9 to overhead shafts 7 of counterbalancing mechanisms 3 but by virtue of its design and components, as explained hereinabove, is also used as a calibrating tool to ensure that proper dimensions of the torsion springs 9 are being used.

Figure 26:
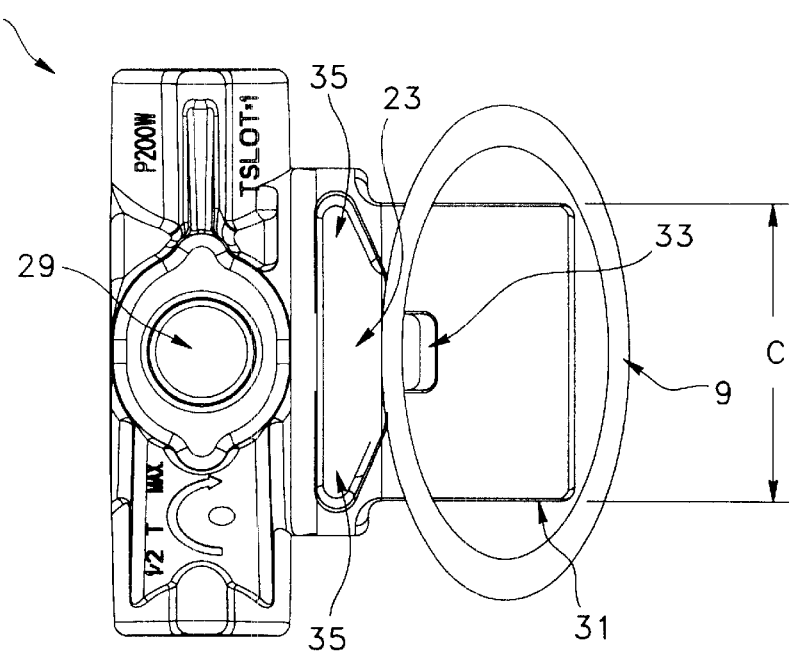
FIG. 26 is a top plan view of what is shown in FIG. 25.

Furthermore, in order to eliminate the cocking problem known in the art due to spring extension and contraction, the length of the collar 15 has been optimized and the hooking slot 23 of the collar 15 is preferably substantially V-shaped, as better shown in FIG. 26. This shape literally wedges the spring tail therein, thus resulting into two beneficial effects. Firstly, the spring 9 is maintained against the head of the plug 1, which in turn provides greater stability. Secondly, the tail is maintained in a vertical position, as better shown in FIG. 27, which prevents the waving or cocking phenomenon, by picking the first coil to return to its original position before Its inside diameter is too small to move.

Preferably, the collar 15 and the flange 17, as well as the other components of the plug 1, are made integral to each other, that is, they are all preferably made of one single material. Furthermore, the plug is preferably made of an appropriate material, such as a metal, polymer, etc., and by means of a corresponding suitable manufacturing process, such as die casting, injection molding, etc., as it is well known in the art, depending on the applications for which the plug 1 is intended for, as apparent to a person skilled in the art.

As may now be appreciated, the present invention is an improvement and presents several advantages over other plugs known in the prior art, such as the one illustrated in FIGS. 2 to 9. For example, the plug 1 according to the present invention, namely due to its shouldering floor 27, enables to prevent a spring tail which would be too long from touching the overhead shaft 7 in order to eliminate the possibility of the shaft 7 being damaged, this in turn preventing the shaft 7 from failing and thereby preventing personal injuries or preventing the counterbalancing mechanism 3 from becoming inefficient or inoperable. The plug 1 according to the present invention is also advantageous in that it enables, as explained hereinabove, to diminish the phenomenons known as "clamping" and "cocking". Another advantage of the plug 1 according to the present invention is that it enables to use a greater number of total active spring coils than what is possible with some of the plugs known in the prior art. Another important advantage of the present invention is that the different components of the plug 1 enable to ensure that a torsional spring 9 hooked thereon has appropriate dimensions, namely a minimum inside diameter, a maximum thickness and a maximal spring tail length, so that a torsional spring 9 falling outside these preselected values will not be able to be mounted onto the collar 15. Therefore, as can be easily understood, the plug 1 according to the present invention also functions as a calibrating tool. The plug 1 according to the present invention is also advantageous In that it helps attenuate the "cocking" that tends to occur in the spring 9 due to extension and contraction, as explained hereinabove. The present invention is also advantageous in that it allows the free ends 25 of the torsion springs 9 (also known as "spring tails") to be hooked onto the slots 23 of the plugs 1, easily, quickly, safely, and reliably, without any special tooling, so that the spring tails can be safely inserted into the collars 15 without scraping the overhead shaft 7. Conversely, the present invention also allows the same spring tails to be hooked off the slots 23 of the plugs 1, with the same abovedescribed advantages, for an easier maintenance and/or repair to the counterbalancing mechanism 3. The present invention may be used in the garage door industry, with counterbalancing mechanisms 3 of new garage doors 5 or existing garage doors 5. As it is evident from reading the above description, the present invention is a more reliable, easier to use, easier to maintain, safer, quicker and more cost effective plug 1 than those available in the prior art. Furthermore, the present invention may be used with other kinds of doors 5, such as slidable truck doors, or with any other items suspended by a cable, as apparent to a person skilled in the art.

Of course, numerous modifications could be made to the abovedescribed embodiments without departing from the scope of the invention as defined in the appended claims.

What is claimed is:

1. A plug for use in a counterbalancing mechanism of a cable-operated door, said plug being mounted about an overhead shaft and used for operatively connecting said overhead shaft to a torsion spring coaxially mounted thereon, said plug comprising:

a cylindrical collar having opposite first and second portions, said collar being provided with a hooking slot for hooking a free end of the torsion spring therein and said torsion spring having a segment coaxially mounted about the first portion of the collar, the collar being eccentrically mounted about the overhead shaft; and a cylindrical flange rigidly affixed to the second portion of the collar, said flange being used for transferring a torque between the torsion spring and the overhead shaft when the flange is securely fixed about the overhead shaft;

wherein the plug further comprises a shouldering floor of a given length faced against the hooking slot and extending inside the collar, from the second portion towards the first portion thereof, between said collar and the overhead shaft.

2. A plug according to claim 1, wherein the plug is removably connected with fastening means to a fixed structure.

3. A plug according to claim 1, wherein the collar and the flange are made integral to each other.

4. A plug according to claim 1, wherein the hooking slot is substantially triangular-shaped.

5. A plug according to claim 1, wherein the hooking slot comprises a longitudinal groove.

6. A plug according to claim 1, wherein the length of the shouldering floor and the distance thereof from the hooking slot are selected for impeding a torsion spring having a free end of a given maximal length from being hooked onto the plug.

7. A plug according to claim 1, wherein the collar comprises two flat outer surfaces extending longitudinally and in parallel along the collar.

8. A plug according to claim 1, wherein the outer diameter of the collar, the distance between the hooking slot and an extremity of the collar at the first portion thereof, and the distance between the two flat outer surfaces are selected for impeding a torsion spring having a given minimal inside diameter from being hooked onto the plug.

9. A plug according to claim 1, wherein the plug is removably fixed to the overhead shaft by means of set-screws.

10. A plug according to claim 9, wherein the flange of the plug is provided with winding means for presetting a given torque onto the torsion spring prior to securing the plug onto the overhead shaft.

11. A plug according to claim 10, wherein the plug is a winding plug.

12. A plug according to claim 2, wherein the fixed structure is a bracket rigidly mounted to a wall supporting the counterbalancing mechanism of the cable-operated door.

13. A plug according to claim 12, wherein the plug is a stationary plug.

14. A plug for use in a counterbalancing mechanism of a cable-operated door, said plug being mounted about an overhead shaft and used for operatively connecting said overhead shaft to a torsion spring coaxially mounted thereon, said plug comprising:

a cylindrical collar having opposite first and second portions, said collar being provided with a hooking slot for hooking a free end of the torsion spring therein and said torsion spring having a segment coaxially mounted about the first portion of the collar; and a cylindrical flange rigidly affixed to the second portion of the collar, said flange being used for transferring a torque between the torsion spring and the overhead shaft when the flange is securely fixed about the overhead shaft;

wherein the plug further comprises a shouldering floor of a given length faced against the hooking slot and extending inside the collar, from the second portion towards the first portion thereof, between said collar and the overhead shaft; the collar is eccentrically mounted about the overhead shaft; the collar and the flange are made integral to each other; and the hooking slot is substantially triangular-shaped and comprises a longitudinal groove.

15. A plug according to claim 14, wherein the length of the shouldering floor and the distance thereof from the hooking slot are selected for impeding a torsion spring having a free end of a given maximal length from being hooked onto the plug.

16. A plug according to claim 14, wherein the outer diameter of the collar and the distance between the hooking slot and an extremity of the collar at the first portion thereof are selected for impeding a torsion spring having a given minimal inside diameter from being hooked onto the plug.

17. A plug according to claim 14, wherein the plug is a winding plug.

18. A plug according to claim 14, wherein the plug is a stationary plug. having a segment coaxially mounted about the first portion of the collar, the collar being eccentrically mounted about the overhead shaft; and a cylindrical flange rigidly affixed to the second portion of the collar, said flange being used for transferring a torque between the torsion spring and the overhead shaft when the flange is securely fixed about the overhead shaft;

wherein the plug further comprises a shouldering floor of a given length faced against the hooking slot and extending inside the collar, from the second portion towards the first portion thereof, between said collar and the overhead shaft.

19. A plug for use in a counterbalancing mechanism of a cable-operated door, said plug being mounted about an overhead shaft and used for operatively connecting said overhead shaft to a torsion spring coaxially mounted thereon, said plug comprising:

a cylindrical collar having opposite first and second portions, said collar being provided with a hooking slot for hooking a free end of the torsion spring therein and said torsion spring having a segment coaxially mounted about the first portion of the collar, the collar being eccentrically mounted about the overhead shaft; and a cylindrical flange rigidly affixed to the second portion of the collar, said flange being used for transferring a torque between the torsion spring and the overhead shaft when the flange is securely fixed about the overhead shaft;

wherein the plug further comprises a shouldering floor of a given length faced against the hooking slot and extending inside the collar, from the second portion towards the first portion thereof, between said collar and the overhead shaft, said shouldering floor being used for impeding the free end of the torsion spring hooked into the hooking slot from touching the overhead shaft.

* * * * *